United States Patent [19]

Naito

[11] 4,054,796

[45] Oct. 18, 1977

[54] MASS SPECTROMETER WITH SUPERIMPOSED ELECTRIC AND MAGNETIC FIELDS

[75] Inventor: Motohiro Naito, Tokyo, Japan

[73] Assignee: Nihon Denshi Kabushiki Kaisha, Tokyo, Japan

[21] Appl. No.: 698,316

[22] Filed: June 22, 1976

[30] Foreign Application Priority Data

June 24, 1975 Japan ..... 50-79192

[51] Int. Cl.[2] ..... H01J 39/34

[52] U.S. Cl. ..... 250/294; 250/295; 250/296

[58] Field of Search ..... 250/295, 296, 297, 294, 250/292, 281, 282

[56] References Cited

U.S. PATENT DOCUMENTS 3,816,748 6/1974 Harrison ..... 250/296

3,984,682 10/1976 Matsuda ..... 250/296

*Primary Examiner*—Craig E. Church

*Attorney, Agent, or Firm*—Webb, Burden, Robinson & Webb

[57] ABSTRACT

A mass spectrometer comprising superimposed electric and magnetic fields arranged substantially at right angles. The central orbit of the ion beam produced by an ion source is located on an equipotential surface in the electric field. The ion beam is accelerated by a means for producing a constant accelerating voltage. The electric field is swept by a sweep means. The change of the focal length of the superimposed field when the electric field is swept by said sweep means is compensated by a compensating means, thereby providing a mass spectrometer capable of measuring ions having a wide range of mass to charge ratios and capable of scanning at high speed and having a high accuracy mass marker.

6 Claims, 9 Drawing Figures

Figure 1:
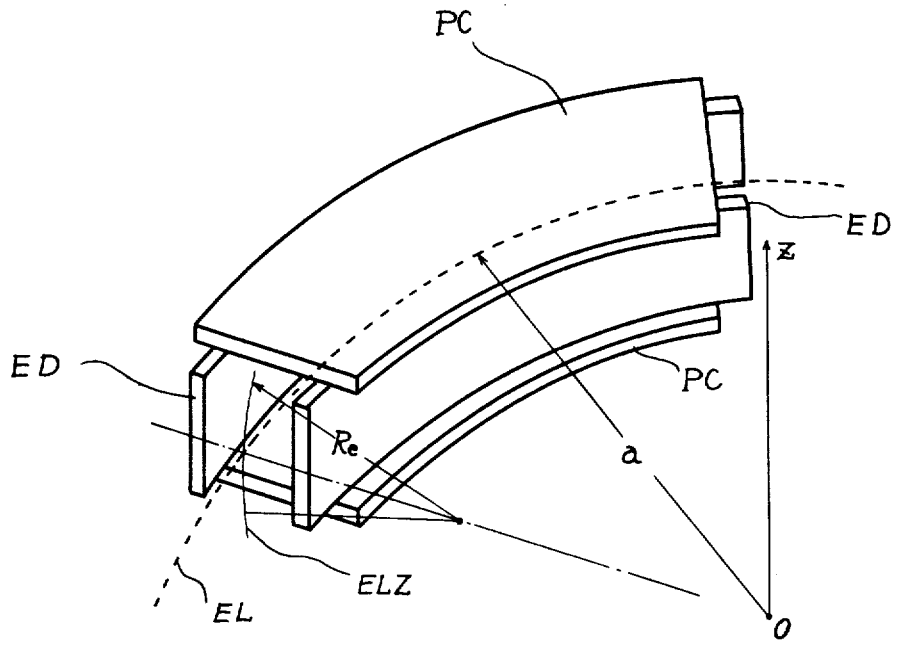

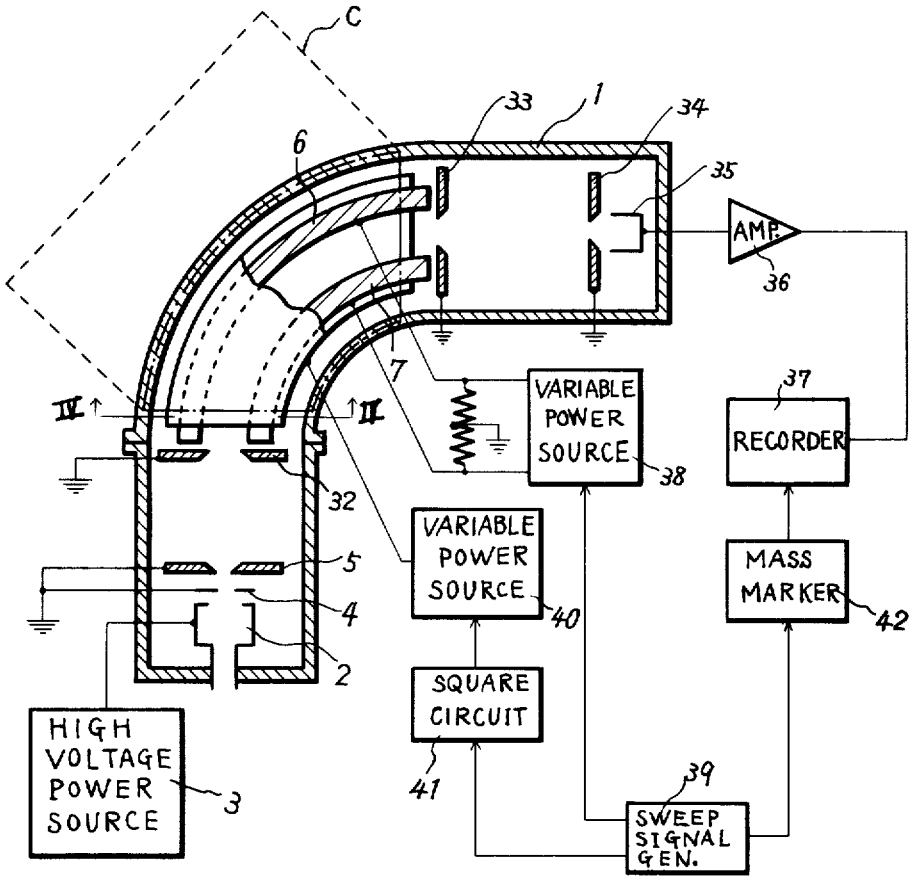
Fig. 3
Fig. 4
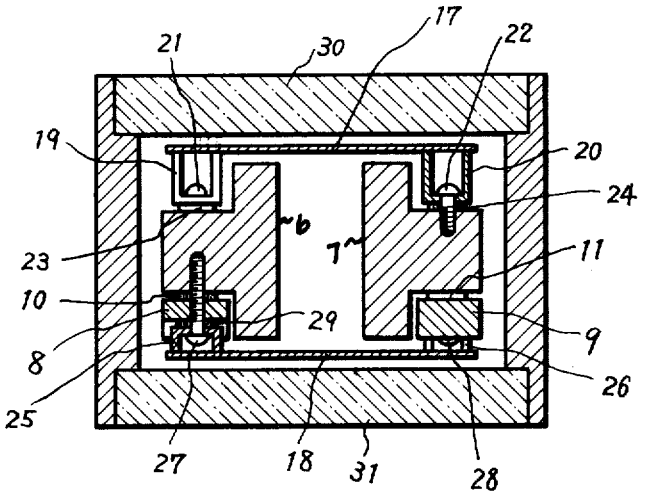

MASS SPECTROMETER WITH SUPERIMPOSED ELECTRIC AND MAGNETIC FIELDS

This invention relates to a mass spectrometer employing a superimposed field comprising an electric field and a magnetic field arranged substantially at right angles, the central ion orbit of the ion beam being located on an equipotential surface in the electric field.

There are two main types of mass spectrometers commonly used in the field of chemical analysis and related research fields: One is the quadrupole type mass spectrometer employing a hyperbolic electric field and the other is a deflecting type instrument in which the ions constituting the ion beam are separated by the magnetic field in accordance with their mass to charge ($m/e$) ratios. In the quadrupole type instrument, when the ion $m/e$ ratio is large, the sensitivity and resolution are adversely affected with the result that the actual measurable range is only mass to charge ratios of 500 or less under routine conditions and mass to charge ratios of 1000 at best. On the other hand, the deflecting type instrument, as compared with the quadrupole type instrument, permits ions with a larger $m/e$ ratio to be measured. The basic relationship for magnetic dispersion devices is $$a = 143.9 \sqrt{MVa/_H} \quad (1)$$

where $a$ = the radius of the orbiting ions in cm, $Va$ = the accelerating voltage for the ion beam in volts, $H$ = the intensity of the magnetic field in gauss and $M$ = the $m/e$ ratio of the ions where $e$ is the charge and $m$ is the mass in atomic mass units. Hence, parameters $a$ or H must be large or V$a$ must be small if ions having a large $m/e$ ratio are to be measured. And, if $a$ is made large, the instrument becomes cumbersome and bulky which is undersirable. Again, if $a$ is left as it is, an attempt to make H large has its limitations as with the pole gap reduced to about 10 mm, the available field intensity would only be about 17,000 gauss. Thus, from a mechanical design point of view, increasing $a$ or H is impracticable. This leaves V$a$ as the remaining parameter. But, if this is reduced, the efficiency of the ion source will deteriorate and, if this deteriorates, the detecting sensitivity will be adversely affected.

It thus can be said that mass spectrometers according to the prior art cannot, without introducing certain deficiencies, detect ions with an $m/e$ ratio sufficiently large to meet the demands of present day chemical analysis research.

Mass spectrometers employing a superimposed field comprising an electric field in which the central orbit of the ion beam is located on the equipotential surface in said electric field substantially at right angles to a magnetic field and which use a comparatively weak magnetic field already exist. However, these instruments, as in the case of conventional deflecting type mass spectrometers, require a small accelerating voltage if ions of a high order $m/e$ ratio are to be measured and thus, they too, suffer from the defect of low detecting sensitivity. Moreover, in deflecting type mass spectrometers and superimposed field type mass spectrometers belonging to the prior art, if the conditions to detections of different $m/e$ ratio of the ions are swept (continuously varied), the current supplied to the electromagnetic excitation coil must also be varied. For that reason, high speed sweep is impossible due to the inductance of the coil and the presence of eddy currents, etc. Further, due to the presence of magnetic field hysteresis and residual magnetism, there is poor correlation between the $m/e$ ratio of the ions to be measured and the current to be supplied to the electromagnetic excitation coil. Consequently, the mass marker is insufficiently accurate with the result that, in instruments of the prior art, it is extremely difficult to obtain a mass marker having accuracies in the order of 1 atomic mass units in the case of $m/e$ ratios above 1000.

One object of this invention is to provide a mass spectrometer capable of measuring ions having a wide range of $m/e$ ratios (from zero to almost infinity) by sweeping the deflection conditions to detect ions by sweeping a finite electric field voltage while keeping the accelerating voltage constant.

Another object of this invention is to provide a mass spectrometer capable of measuring ions having a large $m/e$ ratio at high sensitivity.

A further object of this invention is to provide a mass spectrometer capable of rapidly sweeping the deflection conditions.

A still further object of this invention is to provide a mass spectrometer having a high accuracy mass marker.

How the aforegoing objects are attained will become apparent by reading through the following systematic exposition.

Generally, the position of the ions constituting a beam of ions traveling through an electromagnetic field is indicated by utilizing cylindrical coordinates ($r$, $\phi$, $z$).

BRIEF DESCRIPTION

Briefly, my invention relates to improvements in a mass spectrometer in which electrodes producing a constant accelerating voltage draw an ion beam from an ion source and direct the beam to a dispersing field. The field comprises superimposed electric and magnetic fields at right angles through which the ion beam passes prior to detection. The central ion orbit of the ion beam (that is, the orbit of the ions of mass to charge ratio being detected) is substantially located on an equipotential surface of the electric field. The intensity of the electric field is swept to change the mass to charge ratio of the ions traveling the central ion orbit. My improvements relate to such mass spectrometers provided with apparatus for simultaneously compensating the change in focal length of the superimposed fields when the electric field is swept. According to one embodiment, this is achieved by spaced auxiliary electrodes placed above and below the main electrodes for creating the electric field. The voltage on the auxiliary electrodes is varied as a quadratic function of the voltage across the main electrodes.

In another embodiment, the focal length is adjusted by placing a quadrupole lens downstream from the superimposed field. The voltage applied across the alternate poles in the quadrupole lens varies with the variation in the voltage across the main electrodes.

In another aspect, my improvements relate to simultaneously compensating for the change in focal length and the change in energy dispersion when the electric field is swept. In one embodiment, the energy dispersion is compensated by an electric field arranged in tandem with the superimposed field. In yet another embodiment, the energy dispersion is compensated by yet another superimposed field.

Figure 2:
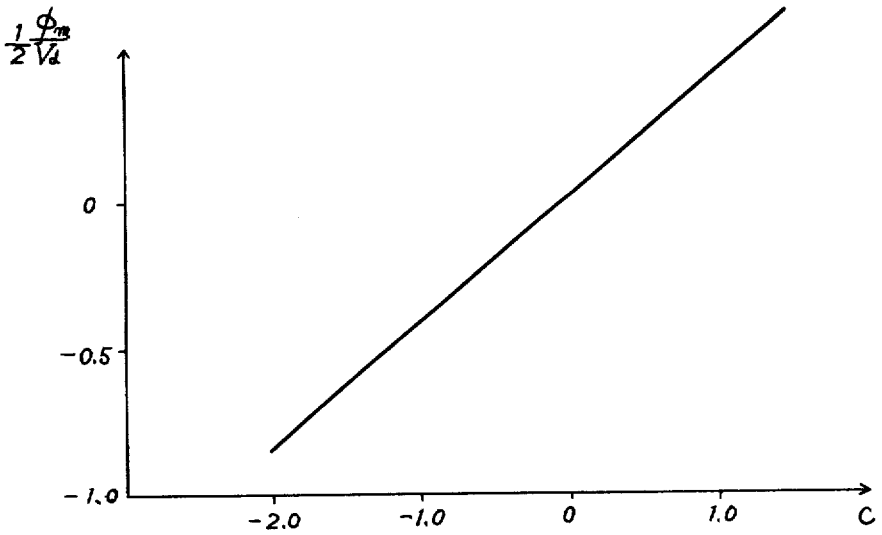
Figure 5:
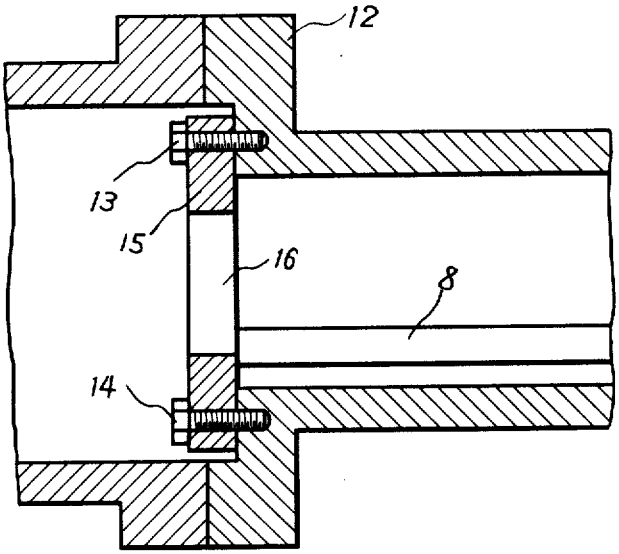
Figure 6:
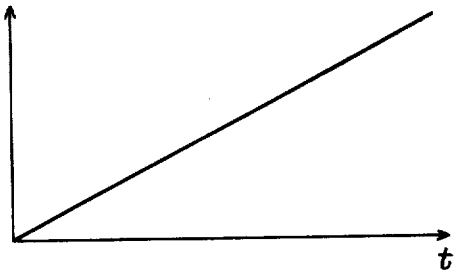
Figure 7:
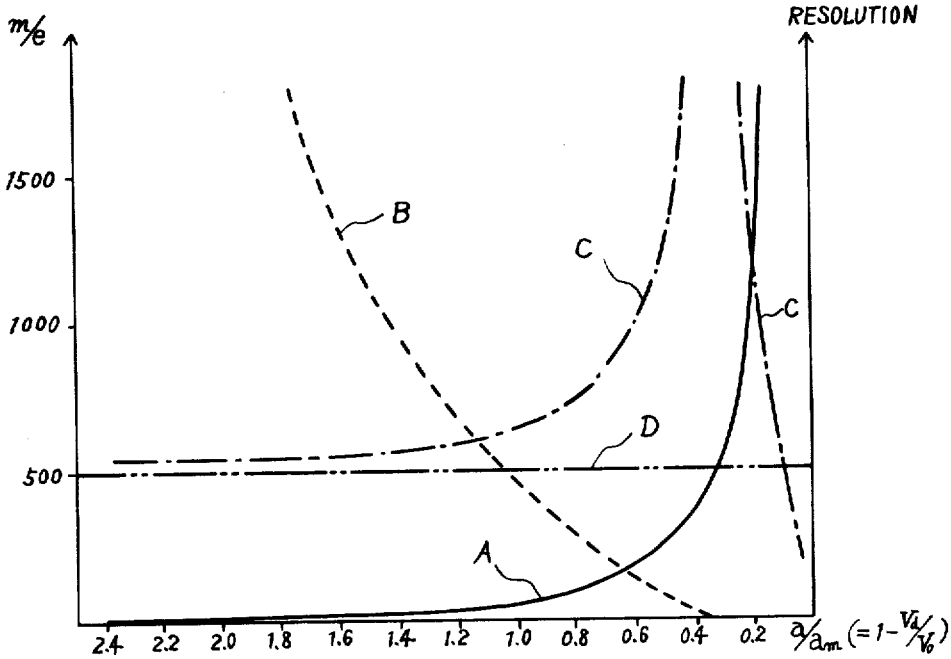
Figure 8:
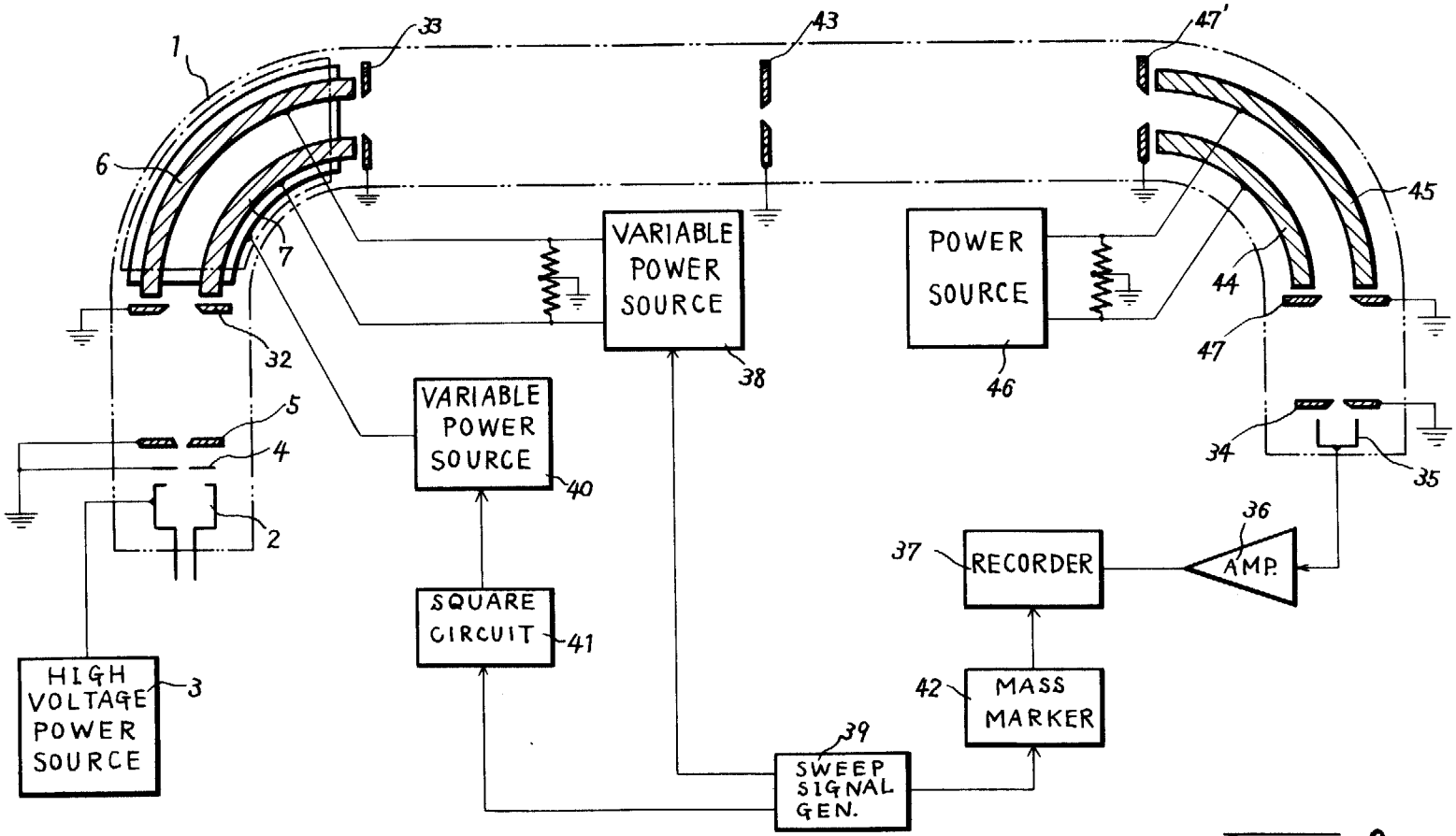
Figure 6:
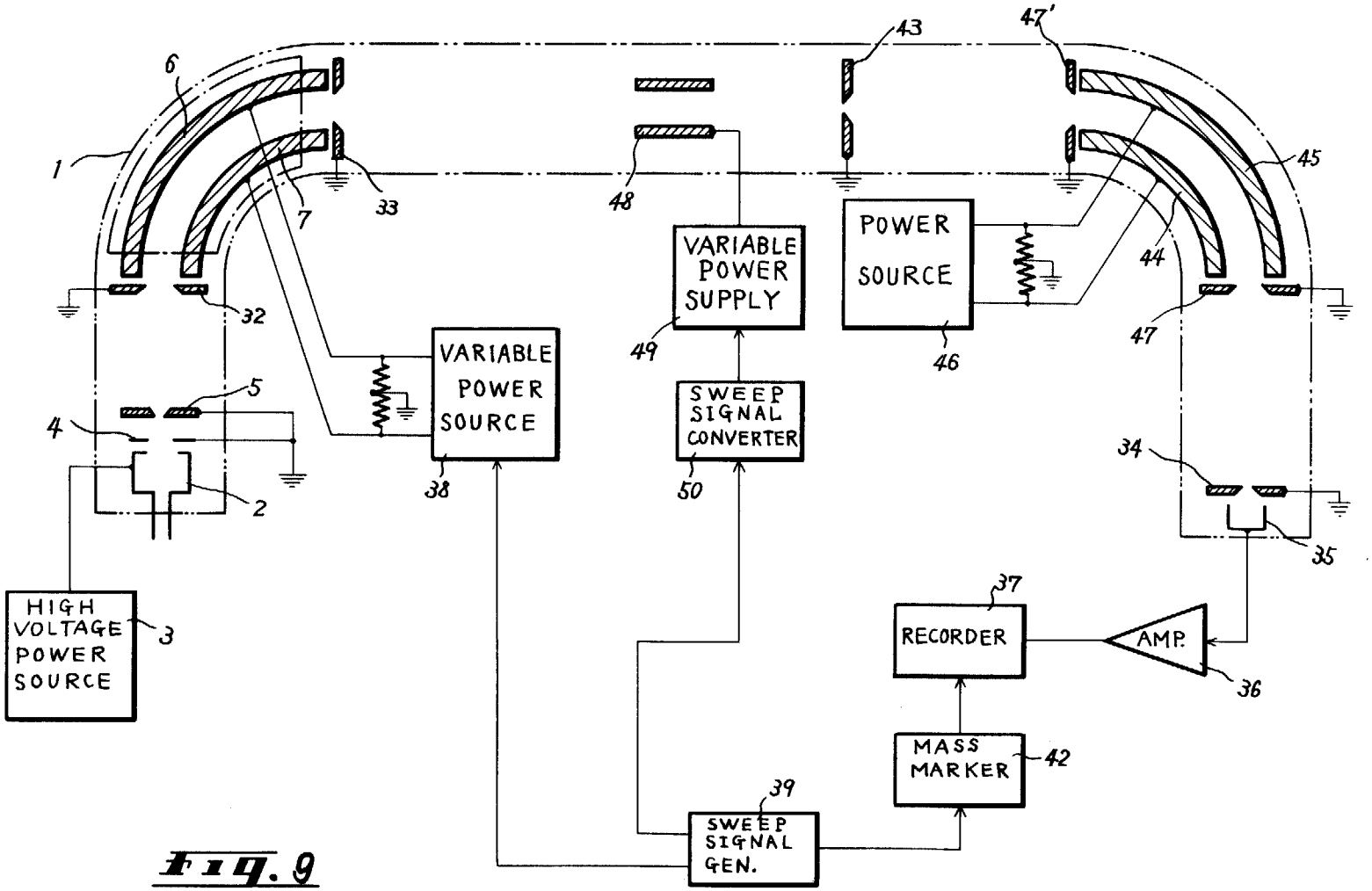

The following describes this invention in detail in conjunction with the accompanying drawings of which:

FIG. 1 is a schematic illustrating the motion of the ions traveling through the superimposed field, FIG. 2 shows the relation between $$\frac{1}{2}\ \frac{\Phi m}{Vd}$$

and C,

FIG. 3 shows one embodiment of this invention,

FIG. 4 shows a cross-sectional view of the embodiment shown in FIG. 3 through IV—IV, FIG. 5 shows the electrode holding members 8 and 9, FIG. 6 shows the output signal from the sweep signal generator, FIG. 7 shows the relation between the electrostatic voltage and the $m/e$ ratio of the ions to be measured in one embodiment of this invention and the resolution of a conventional apparatus and the resolutions of embodiments according to this invention, FIG. 8 shows another embodiment of this invention, and FIG. 9 shows still another embodiment of this invention.

Referring to FIG. 1, ED are electrodes having concentric cylindrically shaped curved surfaces for forming the electric field constituting part of the superimposed field, the equipotential surface being formed more or less parallel to the surfaces of said electrodes. In the same Figure, PC are magnetic pole pieces for forming a vertical magnetic field.

Here, it is assumed that the electric field intensity along a circumference described by $r = a$ in the $Z = 0$ plane is constant, the direction of said field faces inwards towards the center and the magnetic field is parallel with the Z axis.

Now, in order to ascertain the intensity and direction of the electromagnetic field in the vicinity of $Z = 0$ and $r = a$, it is assumed that, $$r = a(1 + \rho) \tag{2}$$

$$Z = a\zeta \tag{3}$$

where $\rho \cdot \pi << 1$

By first approximation, the equation for determining the orbit of the ions in the above superimposed field is given by $$\frac{d^2\rho}{d\phi^2} = -K_r^2(\rho - \delta) \tag{4}$$

in the $r$ direction and $$\frac{d^2\zeta}{d\phi^2} = -K_z^2\zeta \tag{5}$$

in the $z$ direction.

Here, the coefficient $K_r^2$ and $K_z^2$ are determined according to the properties of the electric and magnetic fields. Thus, $$K_r^2 = 3 + l - \frac{a}{a_m}(3 + l - n) + \left(\frac{a}{a_m}\right)^2 \tag{6}$$

and $$K_z^2 = -a/a_e(1 + l) - a/a_m \cdot n \tag{7}$$

where $l$ and $n$ are the respective first order Taylor expanded coefficients of the electric and magnetic fields around the central orbit of the ion beam, and $a_m$ and $a_e$ are the radii of the curvature of the ion beam assuming that the magnetic and electric field exist independently.

If the magnetic field is uniform, that is $n = 0$, (6) and (7) are replaced thus, $$Kr^2 = (3 + l)(1 - a/a_m) + (a/a_m)^2 \tag{6'}$$

and $$K_z^2 = -a/a_e(1 + l) \tag{7'}$$

Again $l$ can be expressed as $$l = -(1 + C) \tag{8}$$

where $C$ is the ratio of the radius of curvature a of the equipotential line EL which accords with the central orbit of the ion beam in the central orbit plane and the radius of curvature $R_e$ of the equipotential line ELZ which passes though the central plane included in the Z axis; viz., $$C = a/Re \tag{9}$$

Further, $\delta$ in equation (4) is a dispersion factor related to the kinetic energy and mass of the ions is given as follows:

$$\delta = \frac{\gamma + (2 - a/a_m)\beta}{K_r^2} \tag{10}$$

where $\gamma$ and $\beta$ represent the relative variation rates (deviations) of the mass and velocity of the ions respectively. If we let the mass and velocity of the ions in the central orbit equal $m_o$ and $v_o$ respectively, then the mass $m$ and velocity $v$ of the ions being measured can be expressed as follows, $$m = m_o(1 + \gamma) \tag{11}$$

$$v = v_o(1 + \beta) \tag{12}$$

Again, if we let the electric and magnetic field intensity along the central orbit of the ions equal $E_o$ and $B_o$ respectively, the accelerating voltage equal $V_a$, the gap between the electrodes providing said electric field $E_o$ equal d, the voltage applied across the said electrodes equal $V_d$, and the radius of curvature of the ion beam, assuming the electric field $E_o$ or magnetic field $B_o$ to exist independently, equal $a_e$ or $a_m$, respectively, the following relationship is established:

$$m_o v_o^2/a_e = -eE_o = -eV_d/d \tag{13}$$

$$m_o v_o^2/a_m = -ev_o B_o = 2eV_d/a_m \tag{14}$$

on the other hand, in a superimposed field where $E_o$ and $B_o$ both exist, the ions traveling along the central orbit satisfy the following relationship according to equations (13) and (14), $$m_o v_o^2/a = -eE_o - ev_o B_o \tag{15}$$

Accordingly, the following relationship can be deduced from equations (13), (14) and (15)

$$1/a = 1/a_e + 1/a_m \tag{16}$$

SWEEPING THE ELECTRIC FIELD TO CHANGE THE M/E RATIO OF IONS IN THE CENTRAL ION ORBIT:

The following explains how it is possible to sweep the m/e ratio of the detected ions by sweeping only the electric field voltage (i.e., the voltage across the electrodes).

If we assume that the applied magnetic field if infinitesimal and that, in essence, only the electric field exists, that is to say $a_m \rightarrow \infty$ and that the electric field voltage when $a = a_e$ equals $V_o$, the following relationship can be deduced from equation (13), $$\frac{V_o}{d} = -\frac{2V_o}{a} \tag{17}$$

Accordingly, from equations (13) and (17), it can be deduced that, $$\frac{V_d}{V_o} = \frac{a}{a_e} \tag{18}$$

in which case, $$\frac{V_d}{V_o} = \frac{a}{a_e} = X \tag{19}$$

On the other hand, if we let the $m/e$ ratio at $a/am = 1.0$ i.e., $a_e \rightarrow \infty$, $x=0$ equals $M_o$ and M equals the $m/e$ ratio at an optional value of $x$, $$Ha = 143.9 \sqrt{M_o V_a} \tag{20}$$

and $$Ha_m = 143.9 \sqrt{MV_a} \tag{21}$$

can be derived from equation (1). Further, from equations (20) and (21) the following relationship is established; viz., $$M/M_o = (a_m/a)^2 \tag{22}$$

By substitution utilizing equations (16) and (19), equation (22) can be rewritten as follows:

$$M = \frac{M_o}{(1-x)^2} = M_o/(1 - V_d/V_o)^2 \tag{23}$$

This means that if the voltage $V_d$ across the electrodes for constituting the electric field forming part of the superimposed field is swept, the central orbit of the ions having a radius a will pass through the slit as provided, thus making it possible to sweep the $m/e$ ratio M of the detected ions.

RECORDER CHART SPEED

Next, we shall consider how $x$, i.e. $V_d/V_o$ is varied as a function of time in order to record a spectrum so that each peak is recorded as a peak having the same width on the chart paper fed at a constant speed.

From equation (23) it can be deduced that $$\frac{dM}{dt} = \frac{dM}{dx} \cdot \frac{dx}{dt} = M \cdot \frac{2}{1-x} \cdot \frac{dx}{dt} \tag{24}$$

and further, if we utilize equations (16) and (19), and related equations where $dM/M = \gamma$, equation (24) can be rewritten as follows:

$$dt = \frac{dM}{M} \; \frac{(1-x)}{2} \cdot \frac{1}{\frac{dx}{dt}} = \frac{a}{2a_m} \gamma \frac{1}{\frac{dx}{dt}} \tag{25}$$

On the other hand, the superimposed field mass dispersion $D_\gamma$ is expressed as follows:

$$D\gamma = \frac{a}{2a_m} \gamma \frac{(1+W)}{K_r^2} = K\, a/2a_m \gamma \tag{26}$$

where $W$ equals the image magnification of the superimposed field and $(1 + W)/K_r^2 = K$.

If we let the beam width at the final slit equal b'' and the objective slit width equal $S_o$ then $$b'' = S_o W \tag{27}$$

where $b''$ remains constant regardless of the electric field voltage sweep. If in order to record a spectrum on the chart paper in which each peak has the same width, we let the beam width $b''$ and the mass dispersion $D\gamma$ determined by $\gamma = \Delta M/M$ be equal, then from equation (26) and (27), $D\gamma$ can be expressed as follows:

$$D_{65} = K\, a/2a_m\gamma = S_o W = b'' \tag{28}$$

Thus, by substitution, equation (25) can be rewritten as follows:

$$dt = \frac{b''}{K} \; \frac{1}{\left(\frac{dx}{dt}\right)} \tag{29}$$

Accordingly, in order to carry out sweep so as to record fixed width peaks, it is preferable to vary X; i.e., $Vd/V_o$ as shown in the following equation, viz., $$\frac{dx}{dt} = \frac{1}{V_o} \; \frac{dVd}{dt} = A \tag{30}$$

where A is constant. In this case, the $m/e$ ratio to be swept per unit time deduced from equation (24) is given as $$\frac{dM}{dt} = M_o \left(\frac{M}{M_o}\right)^{3/2} \cdot A \tag{31}$$

As will be understood from the above equation, if the feed speed of the recorder chart paper is fixed, the $m/e$ ratio being swept during a given unit time will decrease when the $m/e$ ratio is large. Actually, this phenomenon presents no problem. However, if the $m/e$ ratio being swept is swept by another sweep means having a sweep speed; e.g., $$X = 1 - \frac{K}{\sqrt{t - t_o}}$$

the sweep of the $m/e$ ratio is carried out at a constant sweep speed.

COMPENSATING FOR CHANGE IN FOCAL LENGTH

As described above, in a mass spectrometer employing a superimposed field, although it is possible to sweep the $m/e$ ratio by sweeping the electric field voltage only , said sweep mode is accompanied by a shift in the focusing position of the ion beam. The reason for this is that by changing $V_d$, since $a_e$ which is interrelated; viz, $1/ae = -\frac{1}{2}d \cdot V_d/V_a$ based on the relationship established in equation (13) is also changed, it is apparent the $K_r$ given in equation (6) is likewise made to vary. One method for satisfying the first order directional focusing pursuant to the sweep of the electric field voltage $V_d$ is to provide auxiliary electrodes of like potential perpendicular to the main electrodes. An electric field is swept with the applied voltage to the main electrodes so that $l$ in equation (6) is varied and the electric field $K_r$ is kept constant.

First of all, we will deal with the case in which the magnetic field is uniform; viz. $n = 0$ in equation (6).

In this case, by establishing a simple relationship between the auxiliary electrode voltage $\Phi_m$ and $V_d$, it is shown hereafter that $K_r$ is always equal to 1.

If we let $K_r$ in equation (6) equal 1, $$1 = (3 + l)(1 - a/a_m) + (a/a_m)^2 \quad (32)$$

In equation (8) since $l = -(1 + C)$, if this is substituted in equation (32), equation (32) is restored to the following equation; viz;

$$C = 1 - a/a_m = a/a_e = V_d/V_o \quad (33)$$

On the other hand, in a superimposed field which consists of an electric field and magnetic field lying at approximately right angles to said electric field, the ratio of the voltage of the auxiliary electrodes $\Phi_m$ and the electric field voltage $V_d$; viz., $\frac{1}{2} \cdot \Phi_m/V_d$ is clearly given as a function of C for example, according to H. Matsuda, Electrostatic Analyzer with variable Focal Length, Mass Spectroscopy (of Japan) 1961, April, Vol. 9, No. 17. According to this $\Phi_m/V_d$ becomes a linear function of C as shown in FIG. 2 and the following relationship is established.

$$\frac{1}{2} \cdot \Phi_m/V_d = U \cdot C \quad (34)$$

(where U is a constant and approximately $\frac{1}{4}$ in the case of the embodiments hereafter described).

If equation (33) is written using equation (34) the following equation is derived.

$$\Phi_m = 2U \cdot C\, V_d = 2U \cdot \frac{V_d^2}{V_o} \quad (35)$$

Accordingly, if the voltage $\Phi_m$ supplied to the auxiliary electrodes (Matsuda plates) pursuant to the sweep of the electric field voltage $V_d$ always varies in proportion to the square of $Vd$, $K_r$ will always be maintained at 1 and the shift in the focal length of the superimposed field concomitant with the sweep of the electric field voltage can be compensated.

Next, in the expanded case where $n \neq 0$, if we let $K_r$ in equation (6) equal $(n + 1)$, then we obtain the following equation (33')

$$C + n = 1 - a/a_m = a/a_e = V_d/V_o \quad (33')$$

Moreover, we also obtain the following equation (35') in lieu of equation (35), $$\Phi_m = 2U(V_d/V_o - n)V_d \quad (35')$$

Therefore, in this case, by varying $\Phi_m$ according to equation (35'), the shift in the focal length of the superimposed field (where magnetic field is not uniform) concomitant with the sweep of the electric field voltage can be compensated in the same way as when the magnetic field in uniform (i.e. $n = 0$).

First Embodiment: Correcting Change in Focal Length With Auxiliary Electric Field FIG. 3 shows a basic embodiment of this invention. In the figure, 1 is an airtight throughway or column, arranged at one end of which is an ionization chamber 2. The positively ionized specimen in the ionization chamber 2 is accelerated by the potential difference $V_a$ created between the ionization chamber and a grounded slit 4 by supplying a positive high voltage to said ionization chamber from a high power source 3. A grounded objective slit 5 is provided for condensing the thus accelerated ions. The ions, after passing through the objective slit 5, travel through free space having ground potential and are then introduced between electrodes 6 and 7. Said electrodes 6 and 7 are for applying an electric field at right angles to the ion trajectory and are made of a nonmagnetic substance such as aluminum whose inner surfaces are cylindrical.

As shown in FIG. 4, which is a cross section through IV—IV in FIG. 3, the electrodes 6 and 7 are arranged on supporting members 8 and 9 via insulators 10 and 11. As shown in FIG. 5, one end of each of the supporting members 8 and 9 are attached by screws 13 and 14 to the inner side of a flange 12 forming part of the column 1 which is welded to the electrode supporting member fixing plate 15. The fixing plate 15 is provided with a passageway 16 for making the ions pass centrally. Returning to FIG. 4, the two electrodes 6 and 7 are interposed between two flat auxiliary electrodes 17 and 18 known as Matsuda plates, said auxiliary electrode 17 being fixed to electrodes 6 and 7 with insulating screws 21 and 22 via auxiliary electrode supporting members 19 and 20. Insulators 23 and 24 insulate the auxiliary electrode 17 from electrodes 6 and 7. Similarly, auxiliary electrode 18 is fixed to supporting member 9 by insulating screws 27 and 28 via members 25 and 26. 29 is an insulator. Magnetic pole pieces 30 and 31 are arranged above and below the auxiliary electrodes 17 and 18, said magnetic pole pieces forming part of the column wall. The magnetic pole piece 30 is shown in FIG. 3 by the dot dash line (—·—·—·) and the broken line C indicates the magnet yoke. Shunts 32 and 33 compensate for the disturbance of the electric field at the end of the electrodes 6 and 7. There is a slit in baffle 34 beyond which an ion collector 35 is arranged. The ion collector output signal is fed into a recorder 37 via an amplifier 36. A variable power source 38 supplies a voltage between electrodes 6 and 7. The variable power source generates an output voltage proportional to the sweep signal from a sweep signal generator 39. A variable power source 40 varies the potential of the auxiliary electrodes 17 and 18, the output voltage of said variable power source 40 being varied in proportion to the output signal from the square circuit 41, said output signal being derived by squaring the output signal from the sweep signal generator 39. The output signal from the sweep signal generator 39 is fed into the recorder 37 via mass marker 42. Thus, the surrounding area of the electrodes 6 and 7 and the magnetic pole pieces 30 and 31 from a superimposed field comprising an electric field and a magnetic field at almost right angles to said electric field as above described.

The ions generated by the ionization chamber 4, after being passed through the objective slit 5, are introduced into said superimposed field formed by electrodes 6 and 7 and pole pieces 30 and 31. The sweep signal generator 39 supplies a signal which increases linearly with respect to time so as to satisfy equation (30) and conform with other setting conditions as shown in FIG. 6. As a result, the output voltage of the variable power source 38 varies in proportion to said signal. Further, the signal supplied to the variable power source 40 for the auxiliary electrodes is varied squarely with respect to time, and the voltage $\phi_m$ applied to the auxiliary electrodes 17 and 18 varies so as to satisfy equation(35). Accordingly, pursuant to the sweep of the electric field voltage of the superimposed field, focal length aberration is not produced over the entire superimposed field, and at each sweep value of the electric field, the ions introduced into the superimposed field are deflected in accordance with the $m/e$ ratio, pass through the slit 34 and are detected by the ion collector 35 one by one. The detection signals resulting therefrom, together with the sweep value display signal from the mass marker 42, are supplied to the recorder 37 and recorded as a mass spectrum. In this case, the relationship between the sweep electric field voltage $V_d$ and the measured mass is shown by "A" in FIG. 7. As will be clearly appreciated from the above described embodiment, in this invention, rapid scan of $m/e$ ratio can be achieved by making the rise of the sweep signal from the above described sweep signal generator 39 large. Also, since hysteresis and residual magnetism in the pole gap concomitant with magnetic field sweep can be eradicated the mass marker 42 output signal is given an extremely accurate mass scale and measurement reproducibility is improved remarkably, as compared with the prior art. Furthermore, in the apparatus according to this invention, by sweeping the electric field voltage over a finite range only, according to equation (23), the $m/e$ ratio can be swept from approximately $0 \sim \infty$ as shown in FIG. 7 curve "A". Again, without reducing the accelerating voltage whatsoever, since ions with a large $m/e$ ratio can be measured, the detecting sensitivity at a large measuring part is improved remarkably.

THE DOUBLE FOCUSING CONDITION

Further, the electrodes 6 and 7 are arranged over the electrode supporting members 8 and 9 and said members 8 and 9 are fixed to the column 1 by the fixing plate 15. Since the magnitude pole pieces 30 and 31 form part of the column wall, the entire apparatus, in addition to being compact, is very easy to assemble since the installation accuracy of the electrodes and magnetic pole pieces is guaranteed by assuring only the accuracy of the supporting member with respect to the column.

Now, if we assume that the ions from the ion source have the same energy distribution, regardless of the $m/e$ ratio, we can determine the resolution of the apparatus described in the above embodiment. Here, in order to avoid any misunderstanding when the later described embodiments are treated mathematically, suffix 1 has been added to $K_r$, a, etc.

Now, if we let the radius of the central orbit of electrodes 6 and 7 equal $a_1$ and the superimposed field image magnification equal $W_1$, the dispersion D can be written as follows:

$$D = a_1 (1 + W_1)\,\delta \tag{36}$$

where $\delta$ from equation (10) is as follows:

$$\delta = \frac{\gamma + (2 - a_1/a_m)\,\beta}{K_{R_1}^2}$$

and the dispersion $D_\gamma$ based on the mass of the ions only is given as:

$$D_\gamma = \frac{a_1}{2a_m} \cdot \frac{1}{K_{r_1}^2}\,\gamma\, a_1 (1 + W_1) \tag{37}$$

On the other hand, dispersion $D_\beta$ from energy only is given as $$D_\beta = (2 - a_1/a_m)\,\frac{a_1}{K_{r_1}^2}\, a_1 (1 + W_1)\beta \tag{38}$$

If we consider that the resolution limited by the energy aberration is determined at the point where the mass dispersion equals to the energy dispersion, we can use the following equation to calculate the resolution limited by the energy aberration viz., $$D_\gamma = D_\beta \tag{39}$$

Accordingly, from equation (37) and (38) we obtain the following:

$$a_1/2a_m\,\gamma = (2 - a_1/a_m)\beta \tag{40}$$

in which case the original resolution $1/R = \gamma$ can be given by the following equation, viz.

$$1/R = \gamma = \frac{a_m}{a_1}(2 - a_1/a_m)\,2\beta = a_m/a_1\,(2 - a_m/a_m)\,\frac{\Delta V_a}{V_a} \tag{41}$$

Accordingly, if we let $$\frac{\Delta V_a}{V_a} = 1,$$

in order to normalize the resolution, the resolution is shown in FIG. 7 curve "B" as a function of $a/a_m$; i.e., $$1 - \frac{V_d}{V_o}.$$

As understood by FIG. 7 curve "B", as the swept $m/e$ ratio becomes large, the resolution becomes small.

The reason is that, as understood by equation (37) and (38), if the $m/e$ ratio becomes large, simultaneously the mass dispersion and the first order energy aberration will decrease and increase respectively.

However, this kind of energy aberration can be compensated by arranging the electric field (which can be set so as to carry out double focusing with respect to an ion beam exited from the superimposed field having ions of any $m/e$ ratio) and by setting the double focusing point of the electric field to an ion beam having a high $m/e$ ratio.

SECOND EMBODIMENT: CORRECTING ENERGY DISPERSION WITH ELECTROSTATIC FIELD

FIG. 8 describes an embodiment of this invention having an extremely high resolution over a large m/e ratio by employing an additional compensating electric field. In FIG. 8, the parts having the same numbers as in FIG. 3 have been omitted from the description as they are the same.

In the FIGURE, 43 is an intermediate slit in a baffle which is arranged in the superimposed field at the image forming position. In order to compensate for the energy dispersion of the ion beam passed through said intermediate slit, spherical shaped electrodes 44 and 45 for forming a spherical electric field in the space have been arranged. Power source 46 applies a voltage across electrodes 44 and 45. 47 and 47' are shunts.

In the above described composition, the ions are dispersed by the superimposed field formed by electrodes 6 and 7 and magnetic pole pieces 30 and 31, they pass through the intermediate slit 43 and enter between the electrodes 44 and 45. If we let the beam width limited by the objective slit 5 equal $b'$ and the first beam width at the first $\alpha$ focusing point passed through the superimposed field equal $b''_1$, then $$b''_1 = -b'_1 W_1 + a_1 \cdot \frac{\gamma + (2 - a_1/a_m)\beta}{K_{r_1}^2} (1 + W_1) \tag{42}$$

Further, if the beam width limited by intermediate slit 43 at the incident side of second electric field equals $b'_2$ and the beam width at the final image forming plane equals $b''_2$, then $$b''_2 = -b'_2 W_2 + a_2 \cdot \frac{\gamma + 2\beta}{K_{r_2}^2} (1 + W_2) \tag{43}$$

(where suffix 2 has been added to K,and W in order to indicate that they are the parameters according to the second electric field.)

and since we can consider that the object at the first image forming point is the object of the second electric field, $b''_1 = b'_2$, then accordingly, $$b''_2 = -W_2 \left[ -b'_1 W_1 + a_1 \frac{\gamma + (2 - a_1/a_m)\beta}{K_{r_1}^2} (1 + W_1) + a_2 \frac{\gamma + 2\beta}{K_{r_2}^2} (1 + W_2) \right] \tag{44}$$

that is to say, $$b''_2 = b'_1 W_1 W_2 +$$

-continued $$\gamma \left[ -a_1 \frac{(1 + W_1) W_2}{K_{r_1}^2} + a_2 \frac{(1 + W_2)}{K_{r_2}^2} \right] + \beta \left[ -a_1 \frac{(2 - a_1/a_m)(1 + W_1) W_2}{K_{r_1}^2} + a_2 \frac{2(1 + W_2)}{K_{r_2}^2} \right] \tag{45}$$

Accordingly, with respect to $a_1/a_m$ satisfying the condition that the coefficient of $\beta = 0$, that is with respect to $a_1/a_m$ satisfying the below relationship; viz.

$$a_1 \frac{(2 - a_1/a_m)(1 + W_1) W_2}{K_{r_1}^2} = a_2 \frac{2(1 + W_2)}{K_{r_2}^2} \tag{46}$$

double focusing is carried out. At the double focusing point, from equation (45)

$$b''_2 = b'_1 W_1 W_2 - \frac{a_1^2}{2a_m} \frac{(1 + W_1) W_2}{K_{r_1}^2} \gamma \tag{47}$$

Accordingly, the mass dispersion term at the point establishing the double focusing condition becomes $$D_\gamma = \frac{a_1^2}{2a_m} \frac{(1 + W_1) W_2}{K_{r_1}^2} \gamma \tag{48}$$

If we assume that ions are accelerated by a constant accelerating energy from the ion source and the energy deviation of the ions is zero, that is we assume $\gamma + 2\beta = 0$, we determine the mass dispersion at any $a_1/a_m$ other than double focusing point as follows:

$$b''_2 = b'_1 W_1 W_2 - a_1 \cdot a_1/2a_m \frac{(1 + W_1) W_2}{K_{r_1}^2} \gamma \tag{49}$$

Likewise, the mass dispersion factor is $$D_\gamma = \frac{a_1^2}{2a_m} \cdot \frac{(1 + W_1) W_2}{K_{r_1}^2} \gamma \tag{50}$$

From the a foregoing, $a_1/a_m$; i.e., $1 - V_d/V_o$ satisfied by equation (46) can be selected by setting the field and properly selecting $K_{r_1}^2$, $K_{r_2}^2$, $a_2$, $W_1$, $W_2$, etc. Further, the specified sweep value $1 - V_d/V_o$ corresponds to the $m/e$ ratio detected by said sweep value as shown in FIG. 7 curve "B". Therefore, if double focusing is carried out at $a_1/a_m = 0.3$, for example, the deterioration in resolution which occurs especially when a large m/e ratio is swept can be compensated.

We shall now determine the resolution in the case when $a_1/a_m = 1 - x = 1 - Vd/V_o = 0.3$. If we substitute $a_1/a_m = 0.3$ in equation (46) in order to obtain an energy dispersion $D_\beta$ in the region where double focusing is not carried out (precisely the domain where $a_1/a_m \neq 0.3$ ), we obtain the following condition:

$$a_1 \frac{1.7 (1 + W_1) W_2}{K_{r_1}^2} = a_2 \frac{2 (1 + W_2)}{K_{r_2}^2} \tag{51}$$

and further, if we readjust the coefficient of $\beta$ in equation (45) using equation (51) we obtain the following equation; viz, $$D_\beta = a_1 \frac{(1 + W_1) W_2}{K_{r_1}^2} (0.3 - a_1/a_m) \beta \quad (52)$$

In the same way as in the previously described case, assuming that the resolution limited by the energy aberration is determined at the point where the mass dispersion equals the energy dispersion, we can use the following equation to calculate the resolution limited by the energy aberration viz: $D_\gamma = D_\beta$, then, $$a_1^2/2a_m \frac{(1 + W_1) W_2}{K_{r_1}^2} \gamma = a_1 \frac{(1 + W_1) W_2}{K_{r_1}^2} \cdot (0.3 - a_1/a_m) \beta \quad (53)$$

Accordingly, the resolution $1/R = \gamma$ can be written as follows, $$\frac{1}{R} = \gamma = \frac{2a_m}{a_1} (0.3 - a_1/a_m) \beta = \frac{a_m}{a_1} (0.3 - a_1/a_m) \times \frac{\Delta V_a}{V_a} \quad (54)$$

If we let $\Delta V_a/V_a = 1$ in order to normalize the resolution, the resolution given by equation (54) is as shown in FIG. 7 curve "C". This resolution is very high at a high $m/e$ ratio unlike the aforementioned resolution given by equation (41) and shown in FIG. 7 curve "B". Further, the resolution of the magnetic field sweep type superimposed field mass spectrometer according to the prior art is given by $1/R = \gamma = \Delta V/V_a$. If we make $\Delta V/V_a = 1$ in order to normalize the resolution, the resolution of the conventional magnetic sweep type mass spectrometer is shown as in FIG. 7 curve "D". Therefore, it is possible to obtain a superior resolution over the entire domain of the $m/e$ ratio compared with the resolution of the conventional magnetic field type mass spectrometer.

THIRD EMBODIMENT: CORRECTING ENERGY DISPERSION WITH SECOND SUPERIMPOSED FIELD

In the above embodiment, only the electric field is utilized as an energy compensating field. However, as an expansion of the above embodiments, a second superimposed field can be utilized instead of the electric field. In such an embodiment, the equation for carrying out double focusing replaces equation (46) as follows:

$$a_1 \frac{(2 - a_1/a_{m1}) (1 + W_1) W_2}{K_{r_1}^2} = a_2 \frac{(2 - a_2/a_{m2}) (1 + W_2)}{K_{r_2}^2} \quad (46')$$

Further, in this case, the mass dispersion factor corresponding to equations (48) and (50) is as follows, $$D_\gamma = \left[ \frac{a_1^2}{2a_{m1}} \cdot \frac{(1 + W_1) W_2}{K_{r_1}^2} - \frac{a_2^2}{2a_{m2}} \cdot \frac{(1 + W_2)}{K_{r_2}^2} \right] \gamma \quad (48') \quad (50')$$

where $a_{m1}$ is the radius of the ion beam assuming the magnetic field $B_{o1}$ of the first superimposed field to exist independently, and $a_{m2}$ is the radius of curvature of the ion beam assuming the magnetic field $B_{o2}$ of the second superimposed field to exist independently. With regard to these two parameters the following two equations can be established according to equation (21); viz, $$B_{o1} a_m = 143.9 \sqrt{MV_a}$$

$$B_{o2} a_m = 143.9 \sqrt{MV_a}$$

Therefore, $B_{o1}$ and $B_{o2}$ can be combined as follows:

$$B_{o1} a_m^1 = B_{o2} a_{m2}$$

In this case, suffixes 1 and 2 are added to $a_m$ and $a$ in order to indicate that they are parameters according to the first and the second fields, respectively.

In equation (48'), if $a_{m1}$ and $a_{m2}$ have the same sign, $D_\gamma$ becomes small due to the cancellation of the first and second terms.

On the other hand, if $a_{m1}$ and $a_{m2}$ have opposite signs, $D_\gamma$ becomes large and the resolution can be further increased.

FOURTH EMBODIMENT: CORRECTING CHANGE IN FOCAL LENGTH WITH QUADRUPOLE LENS

In the above described embodiment, in order to compensate for aberration of the focal point pursuant to the electric field voltage sweep, a proper voltage is applied to the auxiliary electrodes called Matsuda plates along with the electric field voltage sweep. However, it is possible to use a lens for compensating for the focal distance without using auxiliary electrodes.

FIG. 9 describes an embodiment which incorporates this compensating lens. In the FIGURE, a quadrupole lens 48 is arranged in front of the intermediate slit 43, said quadrupole lens 48 being energized by a variable power supply 49. The variable power supply 49 produces an output voltage proportional to the output signal from a sweep signal converter 50 for converting the sweep signal from the sweep signal generator 39. The sweep signal converter 50 serves to convert the sweep signal for supplying said quadrupole lens 48 with an appropriate voltage for compensating the focal point aberration due to the electric field voltage sweep between electrodes 6 and 7 based on the signal converter which energizes the quadrupole lens 48, if the lens bias changes, the ion beam passed through the superimposed field, since it compensates the focal point due to the quadrupole lens 48, an image is always formed on the plane of the intermediate slit 43 and therefore a good quality spectrum can be obtained.

Further, it is alright to arrange the lens means of said quadrupole lens, etc., in front of the electrodes 6 and 7 for forming the superimposed field.

Having thus described my invention with the detail and particularity as required by the patent laws, what is desired protected by letters patent is set forth in the follwing claims:

1. In a mass spectrometer comprising an ion source, means for producing a constant accelerating voltage for drawing an ion beam from said source, means for creating superimposed electric and magnetic fields at right angles through which fields the ion beam is passed prior to detection such that the central orbit of the ion beam is substantially located on an equipotential surface of the electric field, the improvement comprising means for sweeping the intensity of the electric field to change the mass to charge ratio of the ions traveling the central ion orbit, and means for simultaneously compensating for the change in the focal length of the superimposed field when the electric field is swept by the sweep means.

2. The improvement according to claim 1 where in the means for creating the superimposed electric field comprises spaced main electrodes at different potentials, the means for compensating the changes of focal length of the superimposed field when the electric field is swept comprises auxiliary electrodes arranged on opposite sides of the central ion orbit and perpendicular to the main electrodes and means for applying a voltage to said auxiliary electrodes which is a quadratic function of the voltage applied to the main electrodes.

3. The improvement according to claim 1 wherein the means for creating the superimposed electric field comprises spaced main electrodes at different potentials, the means for compensating the changes of focal length of the superimposed field when the electric field is swept comprises a quadrupole lens arranged outside the superimposed field.

4. In a mass spectrometer comprising an ion source, means for producing a constant accelerating voltage for drawing an ion beam from said source, means for creating superimposed electric and magnetic fields at right angles through which fields the ion beam is passed prior to detection such that the central ion orbit of the ion beam is substantially located on an equipotential surface of the electric field, the improvement comprising means for sweeping the intensity of the electric field to change the mass to charge ratio of the ions traveling the central ion orbit, and first means for simultaneously compensating for the change in the focal length of the superimposed field when the electric field is swept by the sweep means, and second means arranged in tandem with the superimposed fields for correcting the increase in energy dispersion when measuring ions having high $m/e$ ratios.

5. The improvement according to claim 4 wherein the second means is an electric field.

6. The improvement according to claim 4 wherein the second means is a superimposed field consisting of an electric and magnetic field.

* * * * *